US012241319B2

(12) United States Patent
Kela et al.

(10) Patent No.: US 12,241,319 B2
(45) Date of Patent: Mar. 4, 2025

(54) FLUSHING ELEMENT, ROCK DRILLING MACHINE AND METHOD

(71) Applicant: SANDVIK MINING AND CONSTRUCTION OY, Tampere (FI)

(72) Inventors: Timo Kela, Tampere (FI); Jussi Peurala, Tampere (FI); Esa Laakkola, Tampre (FI)

(73) Assignee: Sandvik Mining and Construction Oy, Tampere (FI)

( * ) Notice: Subject to any disclaimer, the term of this patent is extended or adjusted under 35 U.S.C. 154(b) by 0 days.

(21) Appl. No.: 18/277,924

(22) PCT Filed: Feb. 18, 2022

(86) PCT No.: PCT/EP2022/054055
§ 371 (c)(1),
(2) Date: Aug. 18, 2023

(87) PCT Pub. No.: WO2022/175438
PCT Pub. Date: Aug. 25, 2022

(65) Prior Publication Data

US 2024/0133254 A1 Apr. 25, 2024
US 2024/0229581 A9 Jul. 11, 2024

(30) Foreign Application Priority Data

Feb. 19, 2021 (EP) ..... 21158220

(51) Int. Cl.
*E21B 21/01* (2006.01)
*E21B 6/04* (2006.01)
*E21B 7/02* (2006.01)

(52) U.S. Cl.
CPC ..... *E21B 21/01* (2013.01); *E21B 6/04* (2013.01); *E21B 7/025* (2013.01)

(58) Field of Classification Search
CPC . E21B 1/24; E21B 21/00; E21B 21/01; E21B 6/04; E21B 7/025
See application file for complete search history.

(56) References Cited

U.S. PATENT DOCUMENTS

2012/0285747 A1* 11/2012 Nilsson ..... E21B 17/03 175/293

FOREIGN PATENT DOCUMENTS

| | | | | |
|---|---|---|---|---|
| EP | 2851502 | A1 | 3/2015 | |
| EP | 2944756 | A1 | 11/2015 | |
| WO | 2008100193 | A1 | 8/2008 | |
| WO | 2009148375 | A1 | 12/2009 | |
| WO | 2011084093 | A1 | 7/2011 | |
| WO | WO-2014081372 | A1 * | 5/2014 | ..... E21B 21/00 |

* cited by examiner

*Primary Examiner* — Caroline N Butcher
(74) *Attorney, Agent, or Firm* — Corinne R. Gorski

(57) ABSTRACT

A flushing element, rock drilling machine and method of providing a flushing space around a shank adapter of a rock drilling machine. The flushing element surrounds the shank adapter passing through it. The flushing element has a feed opening for feeding flushing agent to the flushing space and at least two sealing housings for flushing sealings and wherein the flushing sealings are on opposite axial sides of the flushing space. Furthermore, the flushing element has split configuration whereby it is mountable and demountable in radial direction.

8 Claims, 5 Drawing Sheets

FLUSHING ELEMENT, ROCK DRILLING MACHINE AND METHOD

RELATED APPLICATION DATA

This application is a § 371 National Stage Application of PCT International Application No. PCT/EP2022/054055 filed Feb. 18, 2022 claiming priority to EP 21158220.0 filed Feb. 19, 2021.

BACKGROUND OF THE INVENTION

The invention relates to a flushing element of a rock drilling machine. The flushing element is to be mounted to a tool side end portion of the rock drilling machine whereby it surrounds a shank adapter which is configured to pass through the flushing element.

The invention further relates to a rock drilling machine and method of forming a flushing space around a shank adapter of a rock drilling machine.

In mines and at other work sites different type of rock drilling rigs are used. The rock drilling rigs are provided with one or more booms and rock drilling machines are arranged at distal ends of the booms. The rock drilling machine comprises an impact device provided with an impact piston which is configured to provide a drilling tool with impact pulses via a shank adaptor. Flushing fluid is fed through the shank adaptor and the drilling tool towards a drill bit. Around the shank adaptor is a flushing housing for enabling the feed of the flushing fluid. In known constructions some disadvantages have been detected especially regarding mounting of the shank adapters.

BRIEF DESCRIPTION OF THE INVENTION

An object of the invention is to provide a novel and improved flushing element, a rock drilling machine equipped with such element and a method for forming a flushing space around a shank adapter of a rock drilling machine.

An idea of the disclosed solution is that the flushing element is intended for forming a flushing space around a shank adapter of a rock drilling machine. The flushing element surrounds the shank adapter which is arranged to pass through the flushing element. The flushing element comprises a feed opening for feeding flushing agent to the flushing space and at least two sealing housings for flushing sealings. The flushing element has split configuration whereby it is mountable and demountable in radial direction.

In other words, the split flushing element is configured to form an annular flushing space around the shank adapter and to provide the flushing sealings with axial and radial support. The structure comprises several split seal housings and the split annularly shaped flushing space.

An advantage of the disclosed solution is that the disclosed structure of the flushing element does not limit the use of different shank adapters. Outer diameters of different axial portions of the shank adapter can be dimensioned more freely when the flushing element can be assembled around the shank adapter in radial or transverse direction. The shank adapter is not mounted in a conventional manner by pushing it axially through the flushing structures. Due to the split structure and transverse mounting direction of the flushing housing, outer diameters of a rotation part, a flushing part and a connecting part of the shank adapter can be dimensioned independently in respect to each other. Then more versatile design choices can be applied.

In this document the terms "split" and "split configuration" refer to a structure having non-uniform rim or circumference. The structure can be split or dismantled in radial direction into two, three or more parts or ring-like segments.

According to an embodiment, there are at least two flushing sealings and sealing houses on opposite sides of the sealing space. In addition to, one or both end portions of the flushing element may be provided with end seals and end seal housings for preventing impurities to enter inside the flushing element.

According to an embodiment, the flushing element is an elongated split bushing comprising two halves with longitudinal mating surfaces. The halves define together an axial opening inside which the shank adapter is mountable. An inner surface side of the opening is provided with the sealing housings.

According to an embodiment, the halves are fastened to each other by several fastening screws. In other words, the halves a bolted together.

According to an embodiment, the halves form together several sealing grooves on an inner surface of the split bushing.

According to an embodiment, the mating surfaces of the halves comprise conical surfaces.

According to an embodiment, the flushing element is a split flushing housing comprising a cover element mountable and demountable to a basic structure of the flushing housing. In other words, the split flushing housing is configured to form a front part of the rock drilling machine. The front part is also known as a flushing head. The flushing head is mounted to a front end of a body of a rotation device. In this embodiment the split structure comprises a basic frame part and the removable cover piece.

According to an embodiment, an outer surface of the mentioned detachable cover element forms part of an outer surface of the rock drilling machine and an opposite inner surface of the cover element comprises halves of the sealing houses.

According to an embodiment, the cover element and the flushing head comprise fastening surfaces in longitudinal direction of flushing head.

According to an embodiment, axial length of the cover element corresponds to axial length of the entire flushing head.

According to an embodiment, the flushing head or housing is provided with a uniform non-split frame structure. Then, an elongated sleeve-like flushing element with split structure is implemented. Bearing of the shank adapter is also provided with split structure. Front end of the rock drilling machine may be designed to receive in axial direction a shank module comprising the split and pre-assembled flushing housing and bearing elements. The pre-assembled module can be mounted from an impact side end or from a tool side end of the flushing head, depending on the structure of the flushing head.

According to an embodiment, the disclosed solution relates to a rock drilling machine. The rock drilling machine comprises a body and an impact device for generating impact pulses. There is a shank adapter for receiving the impact pulses and transmitting them as stress waves to a drilling tool connectable to the shank adapter. A rotation device is arranged to turn the shank adapter around its longitudinal axis during the drilling and flushing agent is fed to a flushing head or housing, which is located at a front end of the body. The flushing head comprises a flushing element surrounding the shank adapter, whereby the flushing element forms an annular flushing space for feeding flushing agent through the shank adapter to the drilling tool. The flushing element is a split structure and comprises two or more compatible components. The flushing element is in accordance with the features disclosed in this document.

According to an embodiment, the sealings are split seals comprising at least one split line, whereby the split seal is installable in transverse direction around the shank adapter. In other words, the split seals are not installed in axial direction as conventional seals, whereby they can be installed on a middle portion of the shank adapter even when the inner diameter of the split seal is minor than outer diameters of the shank adapter at its both end portions.

According to an embodiment, the split seal is a single-split rotary seal made of polymeric material.

According to an embodiment, the split seal has a shaped cut differing from a straight cut and being capable to lock and seal ends of the seal together at the cut.

According to an embodiment, the cut is V-shaped, or alternatively it may have an arrow-hook design or ball & socket design, for example.

According to an embodiment, the split seal has double split design, whereby it has two splits. This way the rotary seal may be a segmented sealing ring.

According to an embodiment, the shank adapter comprises a coupling head for connecting the drilling tool and at an opposite end portion is a rotation portion for transmitting torque. The rotation portion is provided with several splines. Between the coupling head and the rotation portion is a flushing portion which is provided with a transverse flushing opening being in contact with an axial flushing portion extending to a distal end of the shank adapter at the coupling head side end. Outer diameters of the coupling head and the rotation portion are greater than an outer diameter of the flushing portion. In other words, the shank adapter has a slim middle section between the thicker ends.

According to an embodiment, the coupling head of the shank adapter comprises a shoulder provided with an axial contact surface and a protruding axial part provided with a coupling thread. In this embodiment, the shoulder is configured to transmit axially propagating stress waves between the impact device and the shank adapter. Typically, the shank adapters provided with the shoulders i.e. shoulder contact adapters, have longer service life compared to so called bottom contact shank adapters. This is due to the fact that in the shoulder contact adapter temperature of the coupling thread remains at lower levels compared to coupling threads of the bottom contact adapter. The present solution allows use of the shoulder adapters without a need to use large dimensioned bearings and sealings surrounding the shank adapter. Further, the disclosed solution provides an easy, quick and handy way to mount and dismount the shank adapter and to replace worn or damaged machine components surrounding the shank adapter.

According to an embodiment, the coupling head of the shank adapter comprises a coupling thread an outer diameter of which is greater than the outer diameter of the flushing portion between the splines and the coupling thread. In this solution a bottom contact shank is disclosed. However, the outer dimension of the coupling thread of the bottom contact adapter can be dimensioned freely without limitations of mounting of the shank adapter, whereby the coupling thread may be larger than typically and may thereby have increased durability when compared to the present bottom contact adapters.

According to an embodiment, the shank adapter is supported axially movably by means of at least one split slide bearing. In other words, the bearing of the shank adapter can be mounted and removed in transverse direction relative to axial direction of the shank adapter.

According to an embodiment, the split flushing element comprises bearing seats or housings for the split slide bearing halves. There may be a split flushing bushing which is provided with seats for the sealings and seats for the bearing components too. When the structure comprises a transversally mountable and removable cover element, the sealing and bearing seats may be formed partly on an inner surface side of the cover element. Alternatively, there may be a separate split bearing element, such as a split bearing bushing, provided with bearing seats for the split bearing elements.

According to an embodiment, the rock drilling machine comprises one or more sensors, sensor modules or measuring devices which are located at a front end portion of the rock drilling machine. Then the sensor has split configuration so that it can be mounted around the shank adapter in radial direction in a similar manner as the disclosed sealing housing and the bearings.

According to an embodiment, the sensor or its components is integrated to be part of the structure of the sealing housing having the split configuration.

According to an embodiment, the sensor is configured to detect stress waves propagating in the shank adapter. The sensor is a contactless sensor and may be an inductive sensor, a capacitive sensor or a sensor detecting changes in magnetic fields. In such sensors there is typically a need to arrange sensing components to surround the sensed object, in this case the shank adapter. When the structure of the sensor or sensing device can be split into two, three or more pieces, it facilitates mounting of the sensor.

According to an embodiment, the disclosed solution relates to a method of providing a flushing space around a shank adapter of a rock drilling machine. The method comprises: surrounding a middle part of the elongated shank adapter by means of a flushing element in order to form the flushing space with an annular shape; sealing the flushing element against the shank adapter by means of at least two flushing sealings supported to sealing housings on inner surface of the flushing element; using a split flushing element comprising at least two connectable components; and connecting the components of the flushing element in transverse direction relative to the shank adapter.

According to an embodiment, the method comprises pre-assembling the flushing element around the shank adapter and mounting the combination of the shank adapter and the flushing element in one piece inside the rock drilling machine. In other words, a pre-assembled shank module is formed.

According to an embodiment, the above mentioned pre-assembly may comprise a pre-assembled bearing element in addition to the flushing element.

According to an embodiment, rock drilling machine comprises a separate split bearing housing or module which is configured to provide support for a slide bearing element.

According to an embodiment, the mentioned bearing element is an integrated part of the split flushing element. Then the flushing element is provided with a bearing housing for receiving the split bearing element.

According to an embodiment, the mentioned split bearing element is made of slide bearing material. The slide bearing material may be of suitable metallic bearing material, for example.

According to an embodiment, bronze-alloy material is used as the above mentioned slide bearing material. The bronze-alloy may be tin bronze, leaded tin bronze, aluminum bronze or manganese bronze, for example.

According to an embodiment, the disclosed method comprises the following mounting steps: mounting a first component of the split flushing element; mounting the shank adapter on the first component; mounting the flushing sealings; and mounting a second component of the split flushing element.

According to an embodiment, the disclosed flushing element and related split components may be utilized in any kind of hydraulic rock drilling machines utilizing a so-called top hammer principle. In this document surface drilling is disclosed only as one example of use, which means that the solution can be used as well in underground drilling machines, bolting devices, exploration devices and any kind of devices wherein top hammering is implemented.

The above disclosed embodiments may be combined in order to form suitable solutions having those of the above features that are needed.

BRIEF DESCRIPTION OF THE FIGURES

Some embodiments are described in more detail in the accompanying drawings, in which.

For the sake of clarity, the figures show some embodiments of the disclosed solution in a simplified manner. In the figures, like reference numerals identify like elements.

DETAILED DESCRIPTION OF SOME EMBODIMENTS

Figure 1:
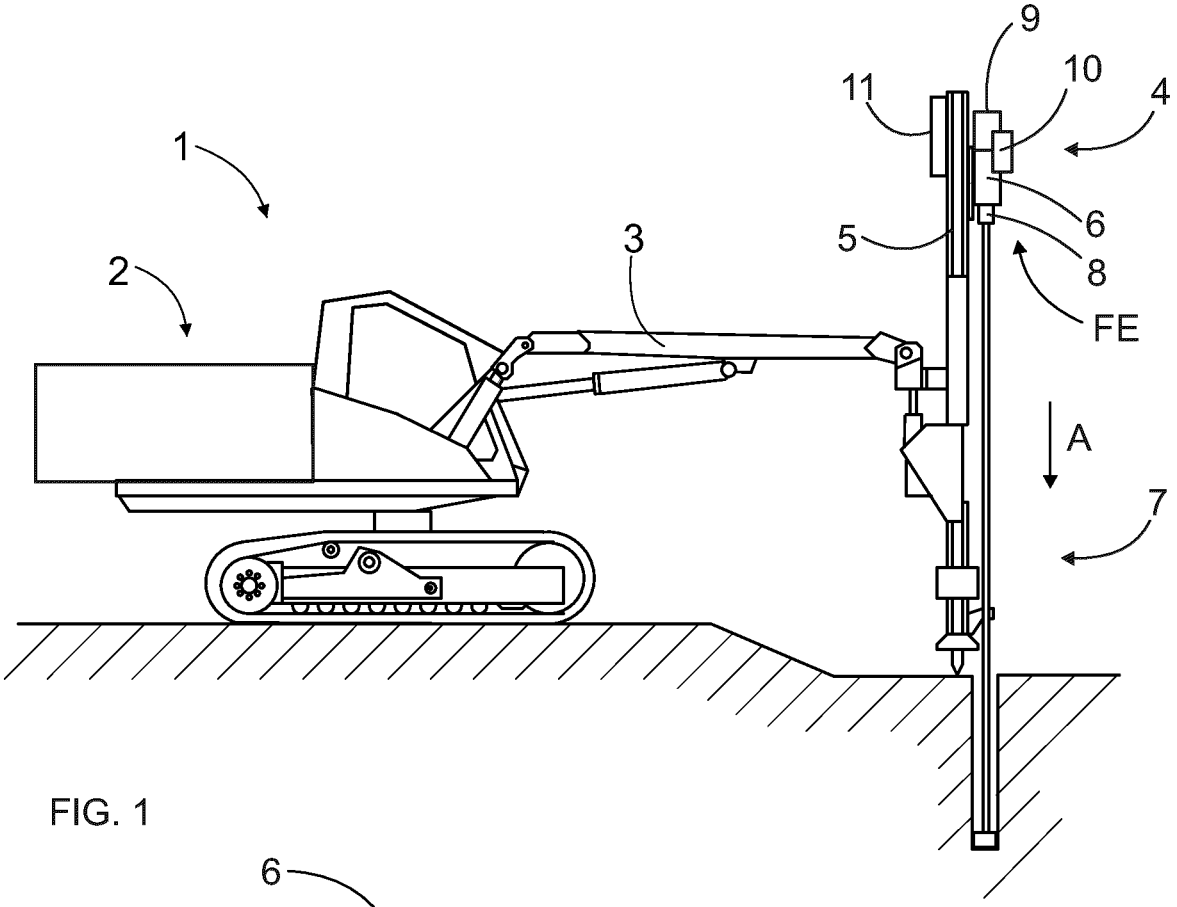
FIG. 1 is a schematic side view of a rock drilling rig for surface drilling.

FIG. 1 shows a rock drilling rig 1 intended for surface drilling. The rock drilling rig 1 comprises a movable carrier 2 and at least one drilling boom 3 connected to the carrier 2. At a distal end portion of the drilling boom 3 is a drilling unit 4 provided with a feed beam 5 and a rock drilling machine 6 supported on it. A drilling tool 7 is connectable to the drilling machine 6. The rock drilling machine 6 comprises a shank adaptor 8 at a front end FE of the rock drilling machine 6 for connecting the tool 7. The rock drilling machine 6 further comprises an impact device 9 and a rotating device 10. The rock drilling machine 6 may be moved towards a drilling direction A on the feed beam 5 by means of a feed device 11. During the drilling impact pulses are generated by means of the impact device to the rotating shank adapter 8 which transmits the impacts pulses and torque to the drilling tool 7. Flushing agent flow is conveyed through a hollow structure to the shank adapter 8 and all the way through the drilling tool 7 to a bottom of the drilled hole for flushing drilling cuttings away from the drilled hole.

Figure 2:
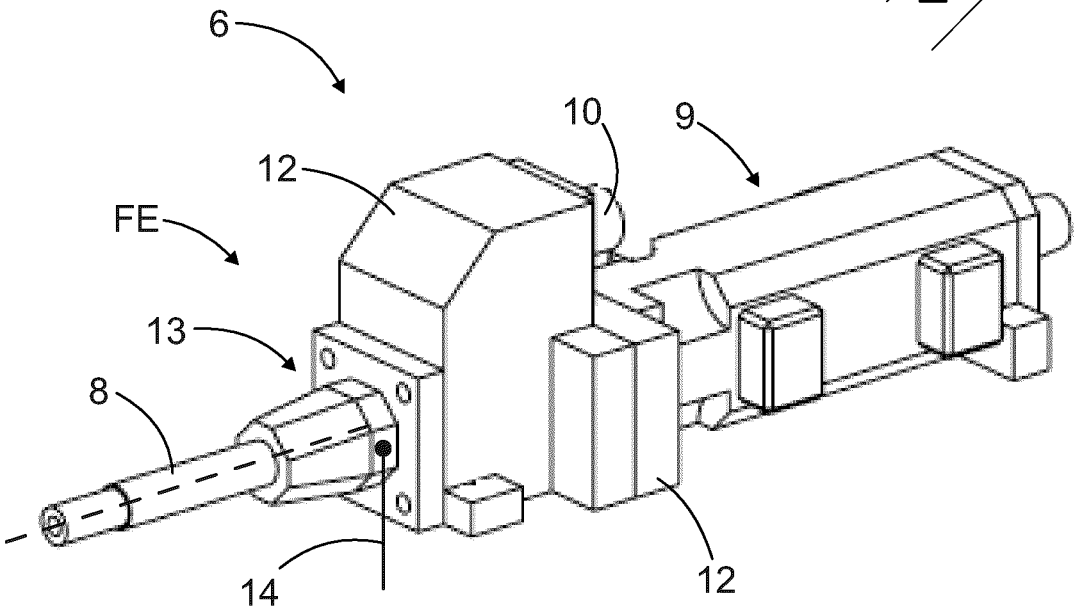
FIG. 2 is a schematic view of a hydraulic rock drilling machine.

FIG. 2 discloses a rock drilling machine 6 comprising a body 12, an impact device 9, a rotating device 10 and a gear housing. Mounted at a front end FE of the body 12 are a flushing housing 13 and a shank adaptor 8. Flushing agent, such as water, is conveyed by means of a flushing channel 14 to the flushing housing 13 or flushing head.

The impact device 9 may comprise an impact piston 48 (shown in FIG. 4) for generating impact pulses IP to the shank adapter 8 in an impact direction. The rotation device 10 and transmission means inside a gear housing make the shank adapter 8 to rotate R around its longitudinal axis as it is shown FIG. 4.

Figure 3:
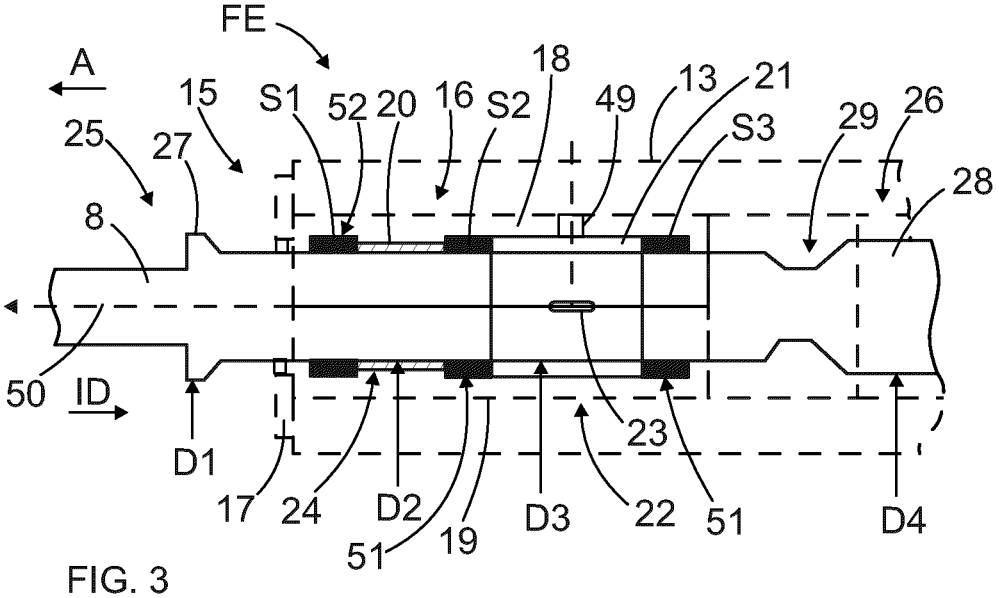
FIG. 3 is a schematic and cross-sectional side view of front part of a rock drilling machine.

FIG. 3 discloses a front end FE of a rock drilling machine in a highly simplified manner. A flushing housing 13 is provided with a pre-assembled shank module 15 comprising a shank adapter 8 and a flushing element 16 assembled around it. The flushing housing 13 may comprise a space inside which the module 15 can be pushed in axial installation direction ID and can be locked in place by means of a flange 17, for example. As can be seen, opposite ends of the shank adapter 8 have greater diameters D1 and D4 compared to diameters D2 and D3 between them. Therefore, the shank adapter 8 cannot be mounted in axial direction inside a frame 18 of a flushing element 19. Instead, the frame 18 has split structure and it comprises two halves mountable to each other in transverse direction. In addition to the frame 18, also sealings S1, S2 and S3, as well as a front bearing element 20 have split configuration. Thus, in the shown structure, the flushing element 19 comprises a split frame, split sealings and split bearings. The frame 18 and seals S2, S3 define together a flushing space 21 around a flushing portion 22 of the shank adapter 8. Flushing agent is fed via a feed opening 49 to a flushing space 21 surrounding the shank adaptor 8 and further through a flushing opening 23 of the shank adapter 8 to an axial passage 50 inside the shank adapter 8 wherein it flows towards a drilling tool.

On an inner surface of the flushing element 19 are at least two sealing housings 51 for receiving flushing sealings S2, S3. The sealing housings 51 are located at axial distance from each other and on opposite sides relative to the flushing space 21. There is also a sealing housing 52 for receiving a front sealing S1. The sealing housings 51, 52 may be sealing grooves or other suitable spaces.

In the disclosed solution diameter D2 of a bearing portion 24 may be minor than diameter D1 of a coupling head 25 of the shank adapter 8 and minor than diameter D4 of a rotation portion 26. This is advantageous for the propagation of the stress waves caused by impact pulses of the impact device. At the coupling head 25, or coupling portion, a shoulder 27 may form the greatest diameter D1. At the rotation portion 26 there may be several splines 28 which are designed to be in contact with a rotating gear of a gearing housing. Greater dimension D1 at the coupling head 25 may be advantageous regarding durability of the coupling and greater dimension D4 at the rotation portion 26 may be advantageous regarding transmission of torque.

The pre-assembled shank module 15 disclosed in FIG. 3 may be supported to the flushing housing 13 also in several alternative ways. For example, it is possible to mount the module 15 in a direction opposite to the disclosed installation direction ID. A further possibility is to design a flushing housing with an openable cover or with a split structure, whereby the module can be installed in one piece in transverse direction.

FIG. 3 further discloses that the shank adapter 8 may comprise surfaces 29 intended for retracting the shank adapter 8 and the connected drilling tool backwards by means of a feed device of a drilling unit when the drilling is completed.

Figure 4:
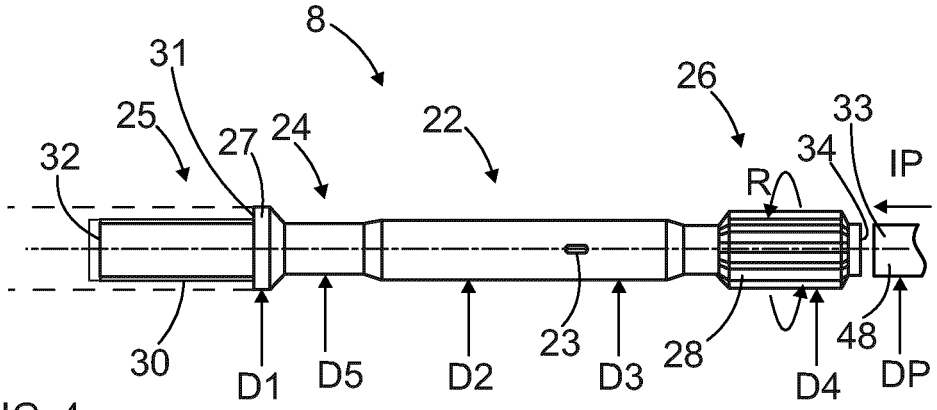
FIG. 4 is a schematic side view of a shank adapter provided with a coupling head implementing shoulder contact with a drilling tool.

FIG. 4 discloses a shank adapter 8 wherein a coupling head 25 comprises a shoulder 27 and a connecting thread 30. The shoulder 27 comprises an axial surface 31 for transmitting impact waves. Between a distal end 32 of the shank adapter 8 and a drilling tool 7 is a clearance. Diameters D1 and D4 are greater than diameters D2 and D3 between them. Diameter DP of a piston 33 and diameter D3 may be substantially equal. At a rear end of the shank adapter 8 may be a portion for receiving impact pulses and provided with an impact surface 34. Diameter D5 of the impact portion may also be equal or substantially equal to the diameter DP of the percussion piston 33. An advantage of this is that then the stress waves propagate well through the shank adapter 8.

Figure 5:
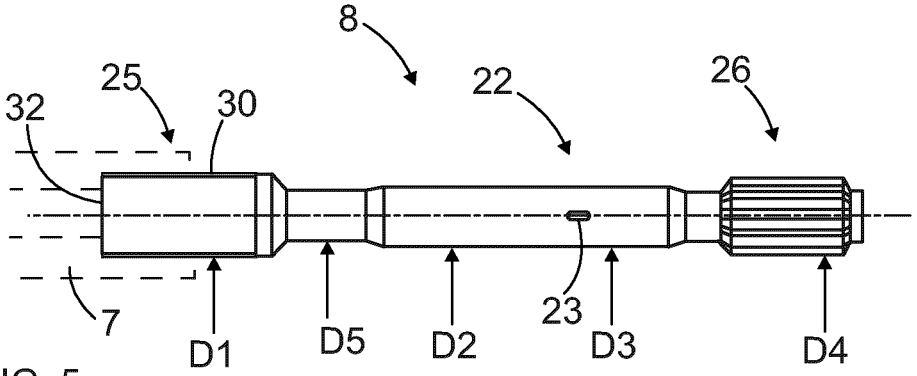
FIG. 5 is a schematic side view of a shank adapter provided with a coupling head comprising a large dimensioned screw surface.

FIG. 4 discloses a so called shoulder contact shank adapter 8, whereas FIG. 5 discloses a so called bottom contact shank adapter 8. In FIG. 5 a distal end 32 of the shank adapter 8 is tightened by means of a thread 30 against a drill tool 7. Diameter D1 of the thread 30 can be dimensioned greater than in typical shank adapters because a split flushing element is intended to be used in connection with it.

In FIGS. 4 and 5 there is further disclosed that the shank adapter 8 may comprise a thinned portion having a diameter D5 which is minor than diameters D1-D4.

Figure 6:
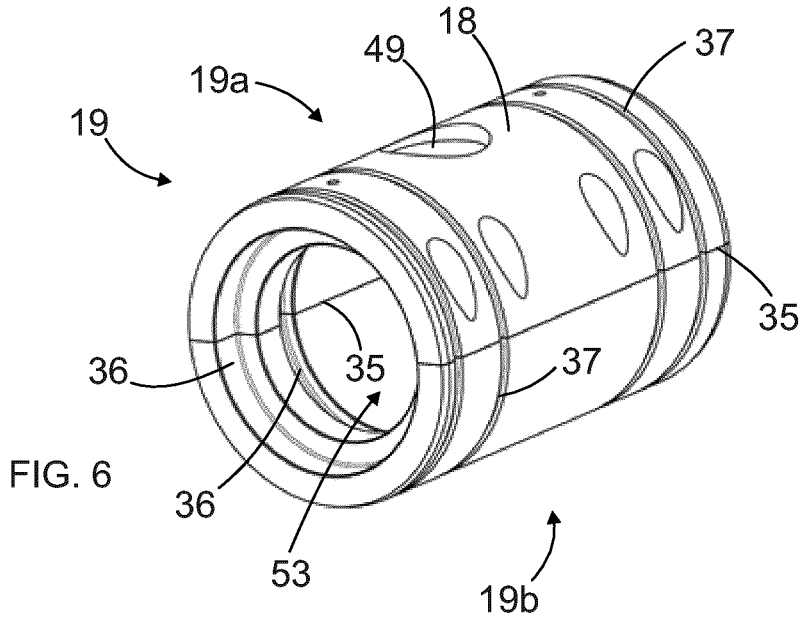
FIG. 6 is a schematic view of a flushing element comprising sleeve-like body with two halves.
Figure 7:
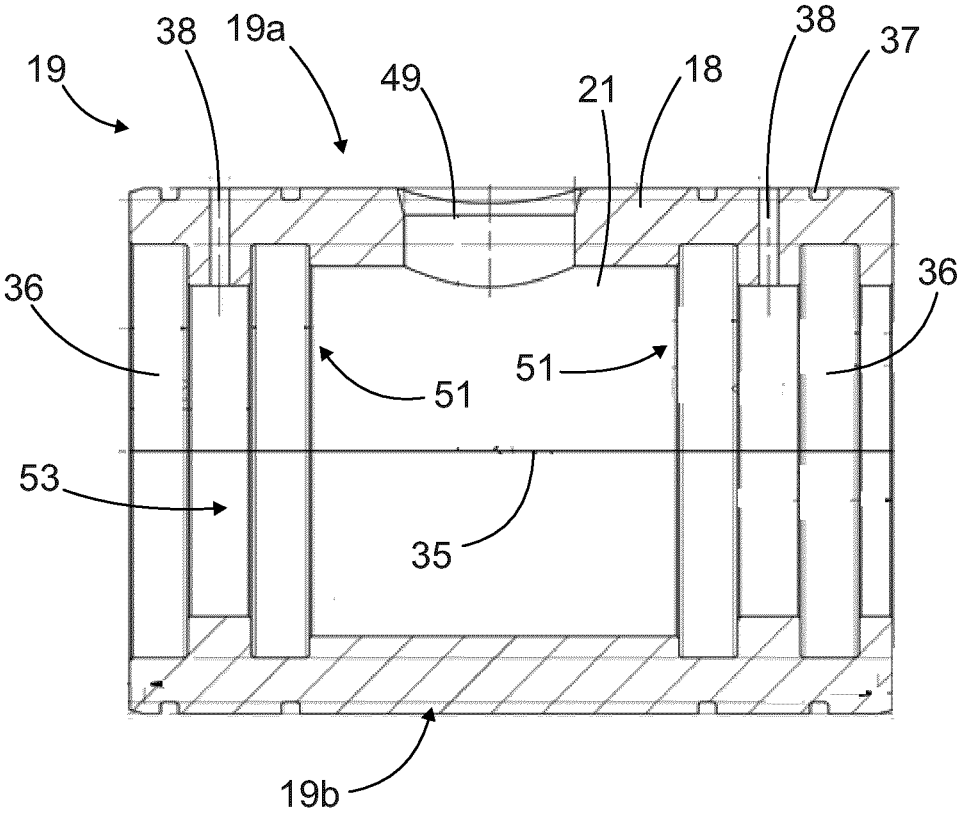
FIG. 7 is a schematic and cross sectional view of the flushing element shown in FIG. 6.

FIGS. 6 and 7 disclose a sleeve-like frame 18 of a flushing element 19 comprising a first halve 19*a* and second halve 19*b*, which can be bolted together. Between the halves 19*a*, 19*b* are joint surfaces or mating surfaces 35. The halves 19*a*, 19*b* define together an axial opening 53 inside which a shank adapter is mountable. On an inner surface of the frame 18 are sealing grooves 36 for receiving sealings facing towards a shank adapter. On an outer surface of the frame 18 are several sealing grooves 37 for receiving sealings facing towards a body of a flushing housing. Number of sealings and sealing grooves 36, 37 may be selected according to the need. Further, there may be leakage channels 38 between two successive sealing elements.

Figure 8:
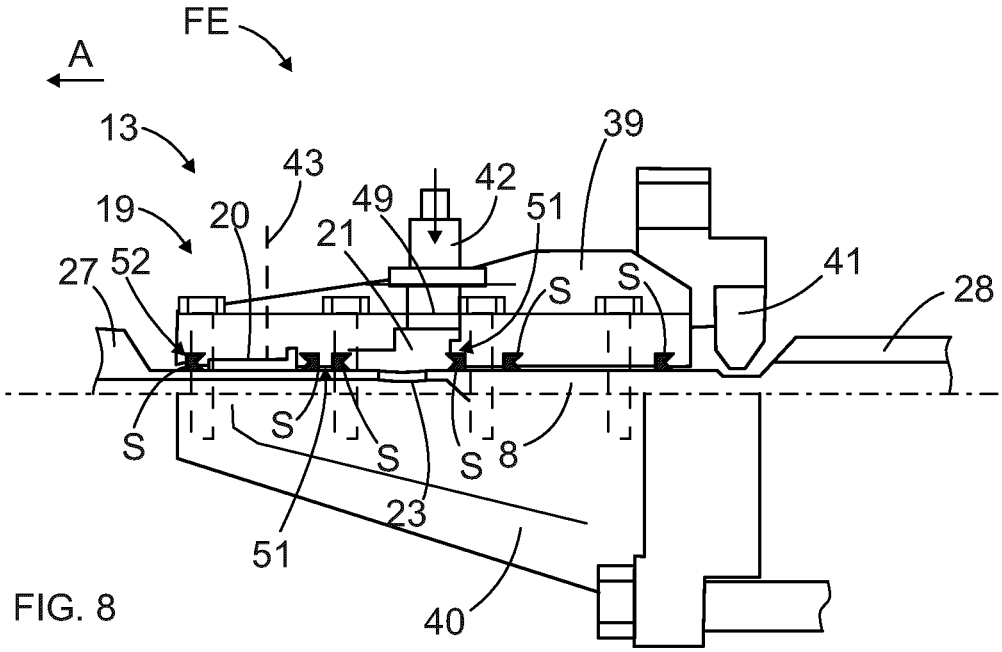
FIG. 8 is a schematic and partly cross sectional side view of a flushing head having a split structure.

FIG. 8 discloses a front end FE of a rock drilling machine comprising a flushing housing 13 provided with an openable cover element 39. In this solution there is a flushing element 19 which is a split flushing housing 19 comprising the cover element 39 which is mountable and demountable to a basic structure 40 or frame of the flushing housing 13. It is easy to dismount and mount the shank adapter 8, seals S and a bearing element 20 in transverse direction when the structure is opened by removing the cover element 39. The cover element 39 may be bolted to the basic structure 40. The seals S and the bearing element 20 have split structures to facilitate their mounting. Also, a support element 41 for serving as retracting aid has a split structure. Flushing agent can be fed through a feed port 42 to a flushing space 21 which may be located on the cover element 39. Further, a lubricating channel 43 may provide the bearing element 20 with proper lubrication.

Figure 9:
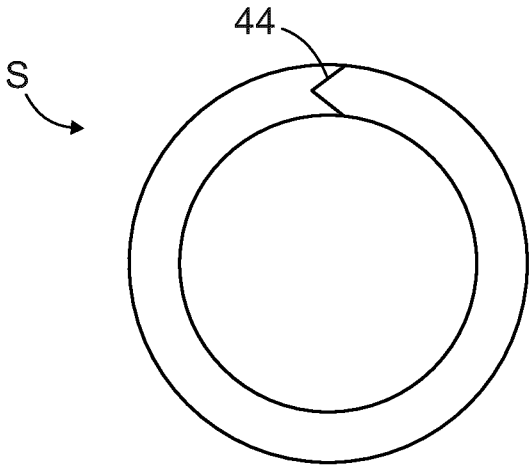
FIG. 9 is a schematic view of a split sealing ring seen in axial direction and comprising a shaped cut.

FIG. 9 discloses a sealing ring S comprising one shaped cutting 44. Because of the cutting 44 or split line, the sealing ring S has a split structure. The split sealing ring S has two ends whereby it can be pushed headfirst to a sealing groove and around a shank adapter.

Figure 10:
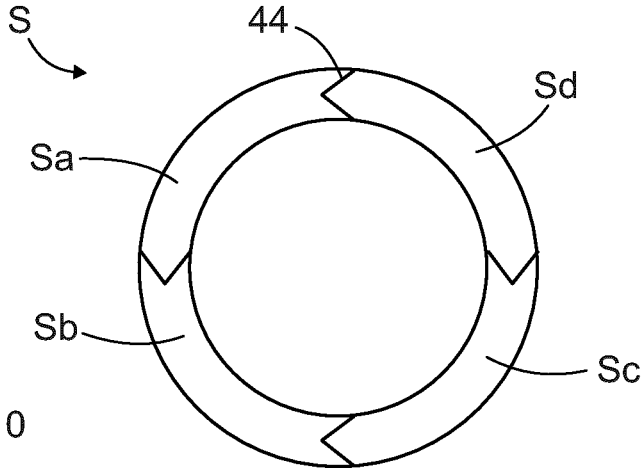
FIG. 10 is a schematic view of a split sealing ring seen in axial direction and comprising several cuts.

FIG. 10 discloses a sealing ring S comprising several cuttings 44. In this case the sealing ring S consists of several pieces Sa-Sd and can be assembled in situ around the shank adapter. Number of pieces may be two and in some case three, or even four. In FIGS. 9 and 10 the cuttings 44 are V-shaped.

Figure 11:
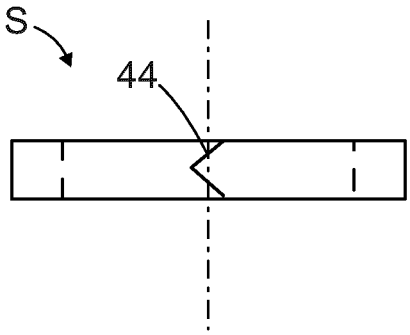
FIG. 11 is a schematic view of a split sealing ring seen in transverse direction and comprising a shaped cut.

FIG. 11 discloses a sealing ring S wherein direction of a cutting 44 differs from the ones shown in FIGS. 9 and 10. In FIGS. 9 and 10 axially directed cuttings or split lines 44 are shown whereas in FIG. 11 the cutting or split line 44 is radial.

Figure 12:
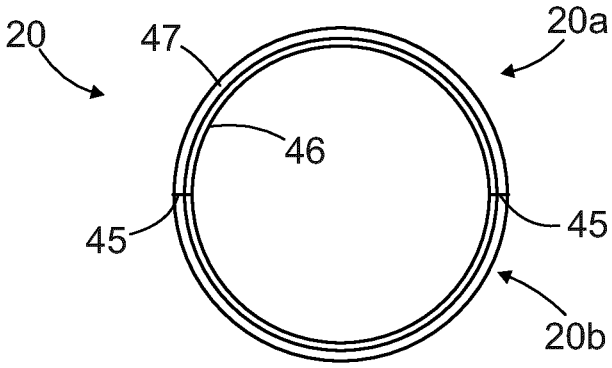
FIG. 12 is a schematic view of a split bearing element comprising two halves.

FIG. 12 discloses a bearing element 20 having a split configuration and comprising two bearing components 20*a*, 20*b* and mating surfaces 45 between them. The bearing element 20 may comprise an elongated bearing portion 46 made of slide bearing material, and further a transverse flange 47 at its one end.

The drawings and the related description are only intended to illustrate the idea of the invention. In its details, the invention may vary within the scope of the claims.

The invention claimed is:

1. A flushing element of a rock drilling machine, the flushing element being configured to surround a shank adapter passing through the flushing element; and wherein the flushing element comprising:

a feed opening arranged for feeding flushing agent to a flushing space surrounding the shank adaptor; and at least two sealing housings arranged for receiving flushing sealings and wherein the sealing housings are located at axial distance from each other and on opposite sides relative to the flushing space, wherein the flushing element has a split configuration having two halves mountable to each other in a transverse direction relative to an axial direction of the shank adapter, and wherein the halves define together an axial opening inside which the shank adapter is mountable.

2. The flushing element as claimed in claim 1, wherein the flushing element is an elongated split bushing, wherein the two halves includes longitudinal mating surfaces, and wherein an inner surface side of the opening is provided with the sealing housings.

3. The flushing element as claimed in claim 1, wherein the flushing element is a split flushing housing including a cover element and a basic structure, whereby the cover element is mountable and demountable to the basic structure of the flushing housing.

4. A rock drilling machine comprising:

a body;

an impact device arranged for generating impact pulses;

a shank adapter arranged for receiving the impact pulses and transmitting the impact pulses as stress waves to a drilling tool connectable to the shank adapter;

a rotation device arranged for turning the shank adapter around its longitudinal axis;

a flushing head located at a front end of the body, wherein the flushing head includes a flushing element surrounding the shank adapter, the flushing element being configured to form an annular flushing space for feeding flushing agent through the shank adapter to the drilling tool, wherein the flushing element is a split structure having at least two compatible components, and wherein the flushing element is in accordance with claim 1.

5. The rock drilling machine as claimed in claim 4, wherein the flushing sealings are split seals including at least one split line, whereby the split seal is installable in a transverse direction around the shank adapter.

6. The rock drilling machine as claimed in claim 4, wherein the shank adapter comprises:

a coupling head arranged for connecting the drilling tool;

a rotation portion located at an opposite end portion of the shank adapter relative to the coupling head, the rotation portion including several splines arranged for transmitting torque;

a flushing portion located between the coupling head and the rotation portion, the flushing portion including a transverse flushing opening in contact with an axial flushing portion extending to a distal end of the shank adapter at the coupling head side end, and wherein outer diameters of the coupling head and the rotation portion are greater than an outer diameter of the flushing portion.

7. The rock drilling machine as claimed in claim 6, wherein the coupling head of the shank adapter includes a shoulder provided with an axial contact surface and a protruding axial part provided with a coupling thread.

8. The rock drilling machine as claimed in claim 4, wherein the shank adapter is supported axially movably by means of at least one split slide bearing element.

* * * * *